US006293597B1

(12) United States Patent
Huang

(10) Patent No.: US 6,293,597 B1
(45) Date of Patent: Sep. 25, 2001

(54) TUBULAR LOCK WITH A BACKSET ADJUSTABLE BY A FOLLOWER PLATE

(75) Inventor: Chao Ming Huang, Kaohsiung Hsien (TW)

(73) Assignee: Taiwan Fu Hsing Industrial Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 09/425,933

(22) Filed: Oct. 25, 1999

(51) Int. Cl.[7] ..... E05C 1/00
(52) U.S. Cl. ..... 292/1.5; 292/337
(58) Field of Search ..... 292/1.5, 337, DIG. 60, 292/169

(56) References Cited

U.S. PATENT DOCUMENTS 4,711,477 12/1987 Fann et al. .
4,750,766 * 6/1988 Shen ..... 292/337
5,149,151 * 9/1992 Shen ..... 292/1.5
5,490,695 * 2/1996 Shiue ..... 292/1.5
5,743,573 * 4/1998 Huang ..... 292/1.5

* cited by examiner

*Primary Examiner*—Gary Estremsky
(74) *Attorney, Agent, or Firm*—Bacon & Thomas, PLLC

(57) ABSTRACT

A tubular lock includes a latch bolt cylinder engaged with a casing consisting of two casing parts. An actuating plate is mounted between the casing parts and includes two separate teeth and two protrusions. A follower plate is in close contact with the follower plate and to which the protrusions bear against. The follower plate also includes two separate teeth. A spindle of the tubular lock bears against two teeth of the follower plate, thereby allowing the actuating plate to retract the latch bolt indirectly. Alternatively, the actuating plate can be directly actuated to retract the latch bolt.

6 Claims, 4 Drawing Sheets

TUBULAR LOCK WITH A BACKSET ADJUSTABLE BY A FOLLOWER PLATE

BACKGROUND OF THE INVENTION

1. Field of the Invention

The present invention relates to a tubular lock with a backset that is adjustable by means of moving a follower plate.

2. Description of the Related Art

U.S. Pat. No. 4,711,477 to Fann et al. issued on Dec. 8, 1987 discloses a duplex latch bolt mechanism that can be adjusted to provide two different backsets. The present invention is intended to provide a different design in this regard.

SUMMARY OF THE INVENTION

A tubular lock in accordance with the present invention includes a follower plate movably mounted between two casing parts. In a shorter backset status, the spindle of the tubular lock bears against two teeth of the follower plate, which, in turn, bears against two protrusions of an actuating plate mounted between the casing parts such that the latch bolt can be indirectly retracted. In a longer backset status, the spindle directly bears against two teeth of the actuating plate such that the latch bolt can be directly retracted.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENTS

Figure 1:
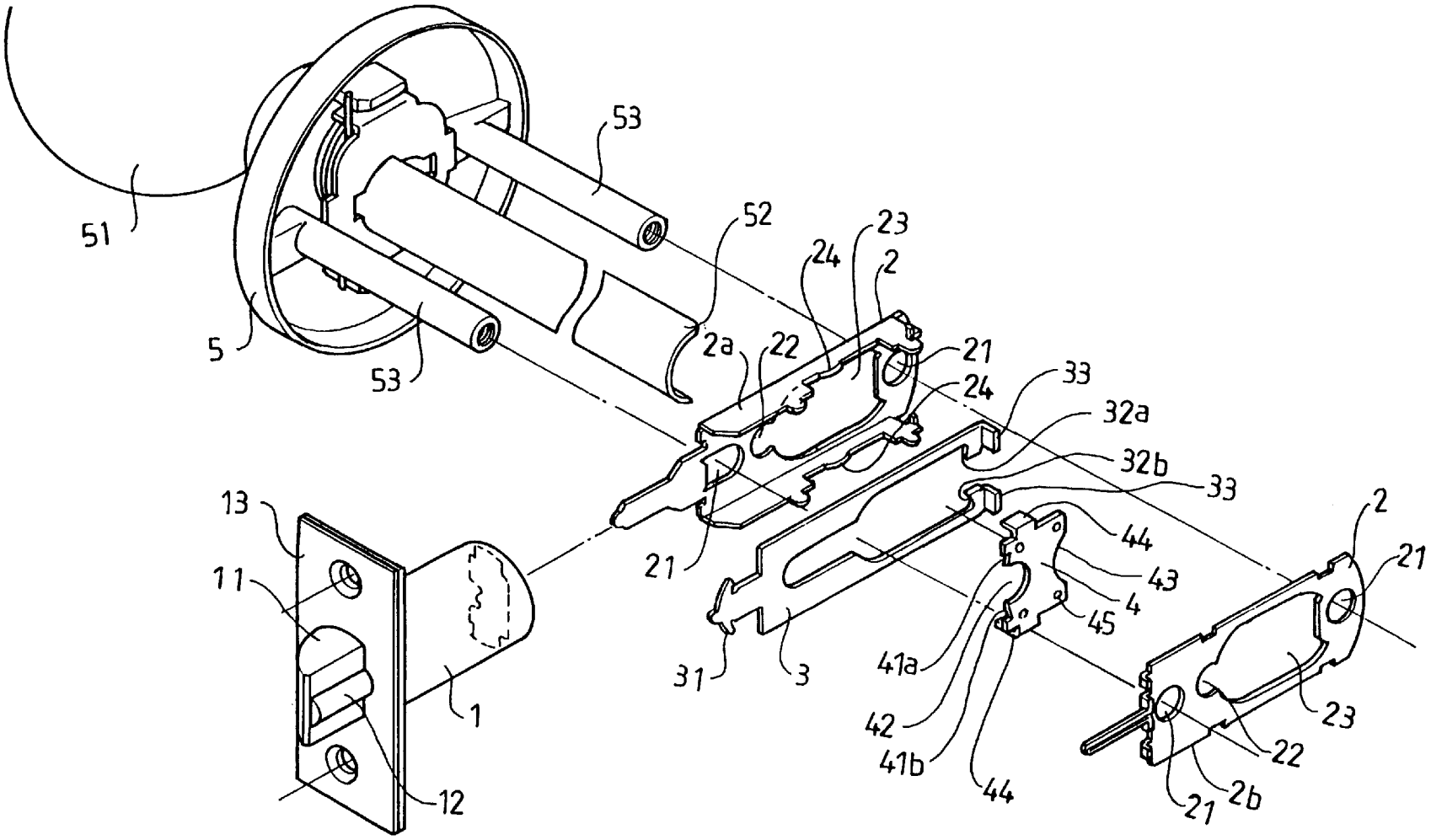
FIG. 1 is an exploded perspective view of a first embodiment of a tubular lock in accordance with the present invention.
Figure 2:
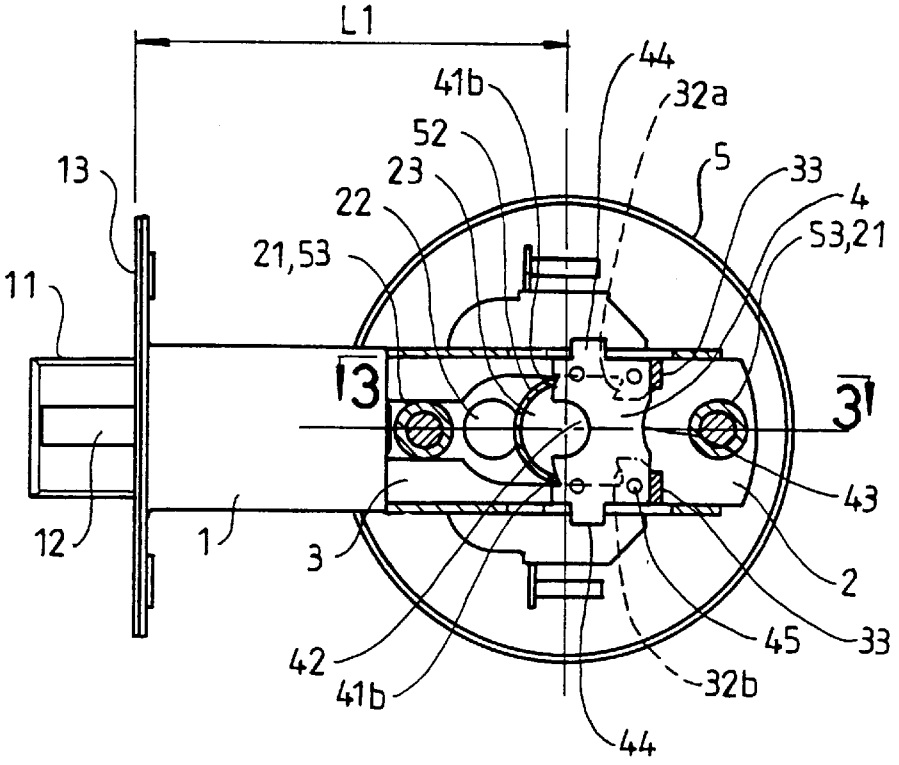
FIG. 2 is a sectional view of the tubular lock in a shorter backset status.
Figure 3:
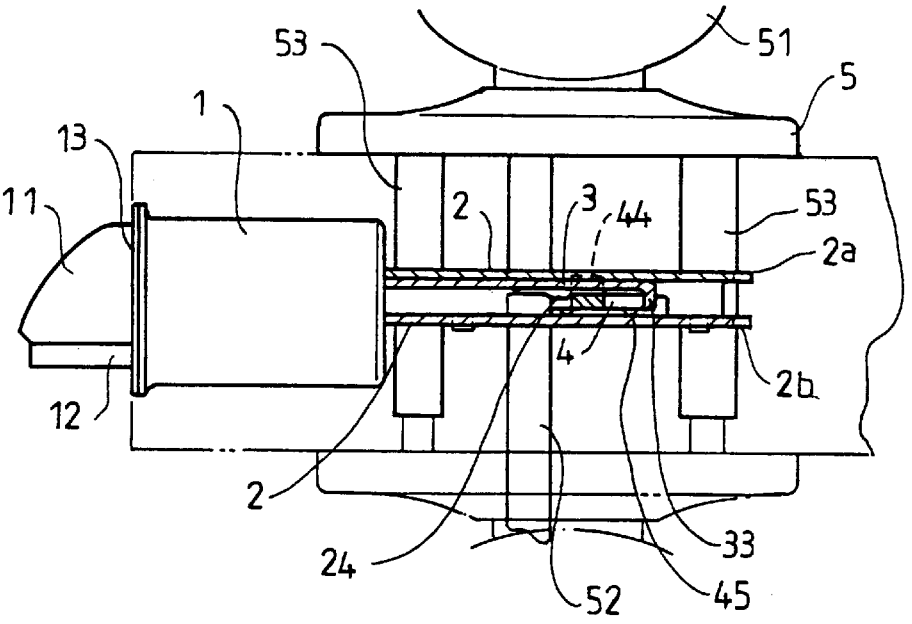
FIG. 3 is a sectional view taken along line 3—3 in FIG. 2.
Figure 4:
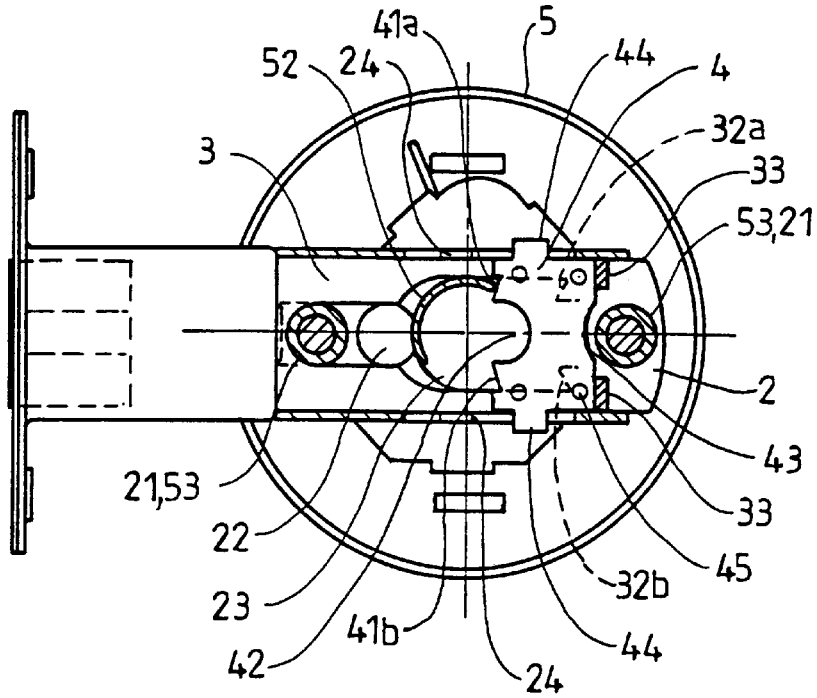
FIG. 4 is a sectional view similar to FIG. 2, wherein the latch bolt is retracted.
Figure 5:
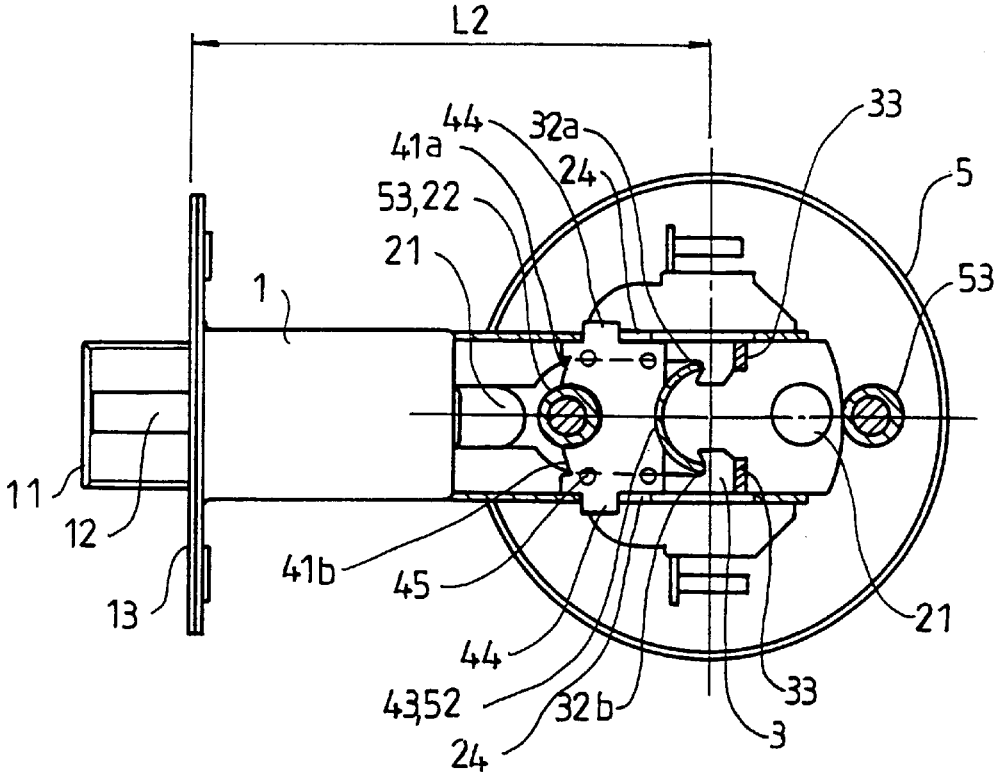
FIG. 5 is a sectional view similar to FIG. 2, wherein the tubular lock is in a longer backset status.
Figure 6:
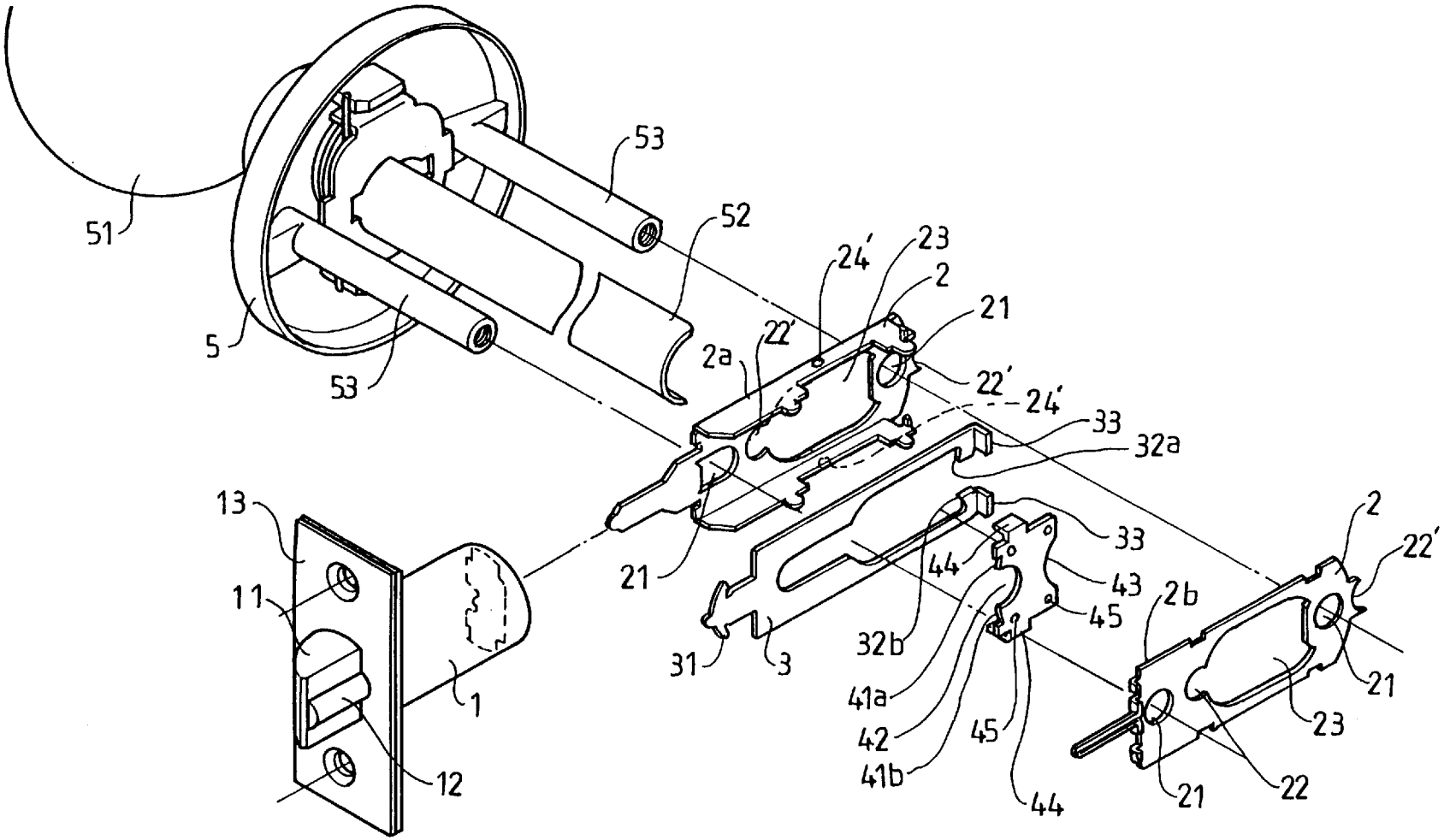
FIG. 6 is an exploded perspective view of a second embodiment of the tubular lock in accordance with the present invention.

Referring to FIGS. 1 through 3, a tubular lock in accordance with the present invention generally includes a latch bolt cylinder 1, a casing 2, an actuating plate 3, and a follower plate 4. The latch bolt cylinder 1 is conventional and includes a latch bolt 11 and an anti-theft pin 12. The latch bolt 11 can be retracted by the actuating plate 3 into a faceplate 13 (FIG. 4), thereby allowing opening of the doorplate (FIG. 3, not labeled). When the latch bolt 11 is not actuated by the actuating plate 3, the latch bolt 11 is biased outward by an elastic element (not shown) and thus extended beyond the faceplate 13 FIGS. 3 and 5), thereby locking the doorplate in place.

The casing 2 consists of two casing parts 2*a* and 2*b* that are assembled and then engaged to an inner end of the latch bolt cylinder 1. The actuating plate 3 and the follower plate 4 are mounted between the casing parts 2*a* and 2*b*. The casing parts 2*a* and 2*b* form aligned first positioning through holes 21 and aligned openings 23 through which a spindle 52 of the tubular lock 5 extends. Each opening 23 includes a recess formed along its periphery defining a positioning recess 22.

The actuating plate 3 includes a first end with a hook member 31 for engaging with and thus retracting the latch bolt 11. A second end of the actuating plate 3 includes an upper tooth 32*a* and a lower tooth 32*b*. One of the teeth 32*a*, 32*b* is actuated by the spindle 52 when the spindle 52 of the lock 5 is rotated, such that the actuating plate 3 is moved away from the latch bolt cylinder 1 for retracing the latch bolt 11. Extended from a side of each tooth 32*a*, 32*b* is a protrusion 33 to which the follower plate 44 bears against.

The follower plate 4 is mounted between the casing parts 2*a* and 2*b* and in close contact with the actuating plate 3. The follower plate 4 also has two separate teeth 41*a* and 41*b*. When the spindle 52 of the lock 5 is rotated, one of the teeth 41*a*, 41*b* is actuated by the spindle 52. The follower plate 4 bears against protrusions 33 of the actuating plate 3. Thus, the actuating plate 3 retracts the latch bolt 11 indirectly. The follower plate 4 further includes a first arcuate recess 42. When the follower plate 4 is moved longitudinally in the casing 2 to a longer backset position, the first arcuate recess 42 is in alignment with the positioning recesses 22 of the casing 2. One of two mounting posts 53 of the tubular lock 5 extends through the positioning recesses 22 of the casing 2 and the first arcuate recess 42 of the follower plate 4 when in the longer backset position. The follower plate 4 further includes a second arcuate recess 43. When the follower plate 3 is in the longer backset position, the second arcuate recess 43 acts as an axle bearing to support the spindle 52 to rotate at a fixed point. In order to assist in easy movement of the follower plate 4 relative to the actuating plate 3, the follower plate 4 may include an extension 44 on each of upper and lower sides thereof. The extension 44 are beyond the casing 2 for easy grasp. In addition, the casing part 2*a* may have two positioning protrusions 24 respectively on two lateral sides thereof for restraining movement of the extensions 44 of the follower plate 4, thereby retaining the follower plate 4 in place. Furthermore, the follower plate 4 may include a number of knurls 45 on a side thereof facing the actuating plate 3 to thereby reduce friction during movement of the follower plate 4.

According to the above description, it is appreciated that the follower plate can be directly moved relative to the latch bolt cylinder to thereby change the backset for the tubular lock, such that the tubular lock can be used in both backset conditions, and the adjusting operation is very simple.

Although the invention has been explained in relation to its preferred embodiment as mentioned above, it is to be understood that many other possible modifications and variations can be made without departing from the spirit and scope of the invention. It is, therefore, contemplated that the appended claims will. cover such modifications and variations that fall within the true scope of the invention.

What is claimed is:

1. A tubular lock with an adjustable backset, comprising:

a latch bolt cylinder with a latch bolt that is retractable into or extended beyond a faceplate of the tubular lock, the latch bolt cylinder having an inner end;

two casing parts assembled together to the inner end of the latch bolt, each of said casing parts forming two first positioning through holes, and an opening, said opening having a recess formed along a periphery defining a positioning recess;

an actuating plate including a first end operably connected to the latch bolt and a second end forming two first teeth and two protrusions, said actuating plate being disposed between said casing parts; and a follower plate slidably mounted between the casing parts and operably connected with the actuating plate to urge extension and retraction of said latch bolt, the follower plate being movable between a shorter backset position and a longer backset position, the follower plate including a first end forming two second teeth and a first arcuate recess, the follower plate further including a second end forming a second arcuate recess.

2. The tubular lock as claimed in claim 1, wherein when the follower plate is moved to the longer backset position, the first arcuate recess of the follower plate is aligned with the positioning recesses of the casing parts.

3. The tubular lock as claimed in claim 1, wherein the second arcuate recess acts as an axle bearing for rotatably supporting a spindle of the tubular lock.

4. The tubular lock as claimed in claim 1, wherein the follower plate includes at least one extension extended beyond the casing parts.

5. The tubular lock as claimed in claim 1, wherein one of the casing parts includes a positioning protrusion for retaining the follower plate in the longer backset position.

6. The tubular lock as claimed in claim 1, wherein each said casing part forms a third arcuate recess located along an end thereof facing away the latch bolt cylinder, the third arcuate recesses being adapted to receive one of two mounting posts of the tubular lock.

* * * * *